US006605181B1

(12) United States Patent
Bergqvist et al.

(10) Patent No.: US 6,605,181 B1
(45) Date of Patent: Aug. 12, 2003

(54) PEROXIDE BLEACH SEQUENCE INCLUDING AN ACIDIC BLEACH STAGE AND INCLUDING A WASH STAGE

(75) Inventors: Anders Bergqvist, Karlstad (SE); Håkan Dahlöf, Edsvalla (SE); Marcelo Leite, Sao Paulo-SP (BR)

(73) Assignee: Kvaerner Pulping Aktiebolag, Karlstad (SE)

( * ) Notice: Subject to any disclaimer, the term of this patent is extended or adjusted under 35 U.S.C. 154(b) by 0 days.

(21) Appl. No.: 08/218,647

(22) Filed: Mar. 28, 1994

(30) Foreign Application Priority Data

Oct. 1, 1993 (SE) ..... 9303233
Oct. 28, 1993 (SE) ..... 9303551

(51) Int. Cl.[7] ..... D21C 9/153; D21C 9/16

(52) U.S. Cl. ..... 162/65; 162/72; 162/76; 162/78

(58) Field of Search ..... 162/40, 65, 76, 162/78, 72

(56) References Cited

U.S. PATENT DOCUMENTS

| | | | | |
|---|---|---|---|---|
| 3,867,246 A | | 2/1975 | Hebbel | 162/78 |
| 5,401,362 A | * | 3/1995 | Lindberg | 162/78 |

FOREIGN PATENT DOCUMENTS

| | | | |
|---|---|---|---|
| AU | 654623 | 1/1994 | |
| EP | 0402335 | 12/1990 | |
| EP | 0 511 695 | * 11/1992 | 162/65 B |
| EP | 0512590 | 11/1992 | |
| EP | 0578304 | 1/1994 | |
| FR | 2593527 | * 7/1987 | 162/78 |
| WO | 9323607 | 11/1993 | |

OTHER PUBLICATIONS

Basta et al, "Lignox and Complimentary Combinations ", Non–Chlorine Bleachings Proceedings, Mar. 2–5, 1992, Hilton Head, S.C., 162–65.B.*
08/051,396 Patent Application Apr. 23, 1993.
08/117,078 Patent Application Jan. 30, 1992.

* cited by examiner

*Primary Examiner*—Steve Alvo
(74) *Attorney, Agent, or Firm*—Dorsey & Whitney LLP

(57) ABSTRACT

A method and device for bleaching chemical paper pulp or dissolving wood pulp, which has been cooked and delignified without employing chlorine-containing chemicals, comprising a bleaching sequence which comprises optionally a first stage comprising a chelation treatment step; a second stage comprising a first peroxide treatment stage, wherein said first peroxide treatment stage is a delignifying peroxide treatment stage in which the amount of peroxide is less than 12 kilo/bone dry metric tons; a third stage comprising an acidic delignifying treatment stage, following said second stage and including a wash, and a fourth stage comprising a second peroxide treatment stage, following said third stage and including a wash, wherein said second peroxide treatment stage is a bleaching peroxide treatment, in which the amount of peroxide exceeds 3 kilo/bone dry metric tons and exceeds the amount of peroxide employed in said second step.

16 Claims, 10 Drawing Sheets

PEROXIDE BLEACH SEQUENCE INCLUDING AN ACIDIC BLEACH STAGE AND INCLUDING A WASH STAGE

Increasingly stringent demands are being placed on the pulp industry to decrease the use of chlorine during bleaching. Permitted discharges of organic chlorine compounds (AOX) in the effluent water from the bleaching plant have been gradually decreased and are now at such a low level that pulp works have in many cases stopped using chlorine gas. The use of chlorine dioxide is also being called into question. The demands made by the environmental authorities in certain countries are so severe that it is difficult to comply with them even if only chlorine dioxide is utilized for bleaching. In addition, consumers have begun to demand paper products which have been bleached entirely without using either chlorine gas or chlorine dioxide, i.e. by so-called TCF (total chlorine free) bleaching.

The pulp industry is therefore seeking methods which permit bleaching of pulp without using these chemicals. A method of this type which has been developed (see SE-A-8902058) involves the unbleached pulp first being delignified with oxygen and then, after washing, being treated with EDTA or another suitable chelating agent in order to remove heavy metals which are bound in the pulp. After the EDTA stage (Q) there follows an intensive peroxide bleaching stage (P), i.e. using hydrogen peroxide. The charge of hydrogen peroxide ($H_2O_2$) is relatively high, being 15–35 kg per ton of pulp, depending on the desired brightness and on the bleachability of the pulp. The time required is rather long, being 4 hours or more, and the temperature high, being 80–90° C. The term "stage" includes a wash in accordance with the TAPPI standard.

A prerequisite for achieving high brightnesses while consuming moderate amounts of bleaching agent is that the pulp, prior to the bleaching, should have been delignified to low kappa numbers, preferably to lower than a kappa number of 16. Normally, taking delignification in the digester house and oxygen delignification too far results in impairment of quality, in particular loss of fibre strength. Nevertheless, in order to achieve a brightness of 85–90% ISO, as required by the market, together with acceptable strength, it is necessary, in order to be able to carry out a chlorine-free bleaching process, that the pulp be produced by a pulping process which yields a low kappa number, less than 20 and preferably less than 15, and a viscosity of at least about 1,000 $dm^3$/kg. This process should preferably contain an oxygen gas delignification stage. However, using the modified cooking methods which have been developed in recent years, it has been found possible to achieve very low kappa numbers without loss of strength. For example, it is possible, using a modification of Kamyr's is continuous cooking process MCC (modified continuous cooking) combined with MC oxygen delignification, to get down to and below a kappa number of 10 with soft wood and a kappa number of 8 with hard wood while retaining strength properties. If the ITC (isothermal cooking) process, for which Kamyr is seeking a patent, is used as well, even lower kappa numbers can be obtained; kappa numbers of less than 15 after the digester, giving less than 10 after oxygen delignification, are readily achieved for soft wood.

The modification according to the ITC process involves the hi-heat washing zone in the lower part of the continuous digester also being utilized for countercurrent cooking (see SE-A-9203462). This is brought about by heating to full cooking temperature in the hi-heat circulation and by adding alkaline cooking liquid to this same circulation. The total cooking time in countercurrent is thereby extended to 3–4 hours as compared with about 1 hour in the case of conventional MCC. This results in a very low lignin concentration being obtained at the end of the cooking, in turn providing improved selectivity in the delignification, i.e. the lignin of the wood is efficiently released without the cellulose being attacked to any appreciable extent. The cooking and the oxygen delignification can thereby be pursued down to very low kappa numbers without impairing the properties of the pulp, ensuring that bleaching with chemicals of the peroxide type and the like can be used for bleaching up to full brightness while retaining acceptable pulp properties.

The relatively high costs associated with using bleaching chemicals, for example peroxide, which do not contain chlorine represent a general problem in connection with chlorine-free bleaching.

The object of the present invention is to produce a method of bleaching chemical paper pulp without using chlorine-containing agents, which method involves the use of peroxide, the peroxide being used in as efficient a manner as possible with a view to being able to achieve, at relatively low cost, a finished bleached pulp of a brightness as required by the market.

Somewhat surprisingly, it has been possible to ascertain, in experiments carried out by Kamyr, that delignification with the aid of peroxide can be carried out using very low charges essentially without any loss as regards the strength properties of the fibres, i.e. almost without any decrease in viscosity. We have found that we can achieve a delignification of more than 35%, in association with a peroxide consumption of less than 5 kilo/BDTM, without any real decrease in viscosity. This must be considered to be very surprising in view of the results which are presented in SE-A-8902058 (Eka Nobel), for example.

In the enclosed diagrams, which are based on some 100 experiments using QP bleaching, with different charges being used and consumption and kappa number, inter alia, being measured, it has been possible to establish, firstly, that nearly all the delignification is achieved with a peroxide consumption of less than 10 kilo, and that a consumption of less than 5 kilo was already sufficient to achieve a major part of the delignification. This in itself is remarkable. In addition, it was possible to establish that this delignification (kappa reduction) with relatively low peroxide charges can be carried out essentially without loss of the strength properties of the fibre, something which, taken as a whole, truly is remarkable. Thus, Kamyr AB, with the aid of the said experiments, has been able to establish that, above a certain consumption, exceeding about 10 kilo/BDTM, which is relatively low, the ability of the peroxide to delignify declines, in principle to zero. This implies that peroxide which is added over and above that, and which is consumed, does not delignify but instead bleaches remaining lignins and attacks the carbohydrates; the consequences of this are that the fibres are attacked and the strength properties are thereby diminished, and that there is a risk of the bleached pulp subsequently yellowing owing to the remaining lignin content.

Using these observations, Kamyr has concluded that, in connection with peroxide bleaching, a first peroxide bleaching stage (preferably after Q) should be used in which the peroxide charge is relatively low and that this peroxide stage should be followed by a delignifying stage, for example using ozone, as a result of which the kappa number is preferably brought below 4, but preferably below 3 and most preferably 1 or less, and that the latter delignifying stage should be followed by an essentially purely bleaching peroxide stage using a higher charge of peroxide. By these means, the peroxide consumption is optimized so that a fully bleached TCF pulp of high quality can be obtained at low cost.

The present object is achieved by a method for bleaching chemical paper pulp, which has been cooked and preferably oxygen-delignified, using methods which preserve viscosity and strength, to low kappa numbers, especially lower than 16, but preferably lower than 10, without employing chlorine-containing chemicals, using a bleaching sequence containing at least 3 stages, whose first stage is a P stage, preferably preceded by a Q stage, characterized by a first P stage which is an essentially delignifying P stage, the charge of peroxide being less than 12 kilo/BDMT, and by a delignifying, acid stage, following the said P stage and preferably including a wash, as well as by a second, preferably alkaline, P stage, following the said acid stage and preferably including a wash, which second P stage is an essentially bleaching peroxide stage, the peroxide charge exceeding 3 kilo/BDMT and exceeding the quantity of peroxide which was added in the said first P stage.

In this context, ozone is an interesting chemical for use in the intermediate delignifying stage, the so-called acid stage. It has been found that the use of an ozone bleaching stage (Z) appreciably decreases the lignin content, i.e. reduces the kappa number. This is important, since a pulp which has been delignified and bleached using only peroxide or oxygen/peroxide still contains a relatively high content of lignin, which accordingly affects the subsequent yellowing tendency of the pulp. Under these circumstances, the pulp yellows when heated or when irradiated with sunlight. Ozone thus removes further lignin, thereby making the brightness of the pulp more stable.

According to a further aspect of the invention, the process is improved by the charge of peroxide in the said first P stage being between 3 and 7 kilo/BDMT, preferably being between 4–6 kilo/BDMT and more preferably about 5 kilo/BDMT.

According to a further aspect of the invention, the process is improved by the charge of peroxide in the said second P stage exceeding 3 kilo/BDMT, preferably exceeding 7 kilo/BDMT, preferably being less than 25 kilo/BDMT, and more preferably being between 11 to 20 kilo/BDMT.

According to a further aspect of the invention, the process is improved by the filtrate from the said second P stage being conveyed to the said first P stage.

The process according to the invention is first and foremost intended for pulp of average consistency, i.e. having a pulp consistency between 5–25%.

According to a further aspect of the invention, the process is improved by the said acid stage being an ozone stage.

According to a further aspect of the invention, a preferred embodiment of a TCF bleaching plant is shown.

Figure 1:
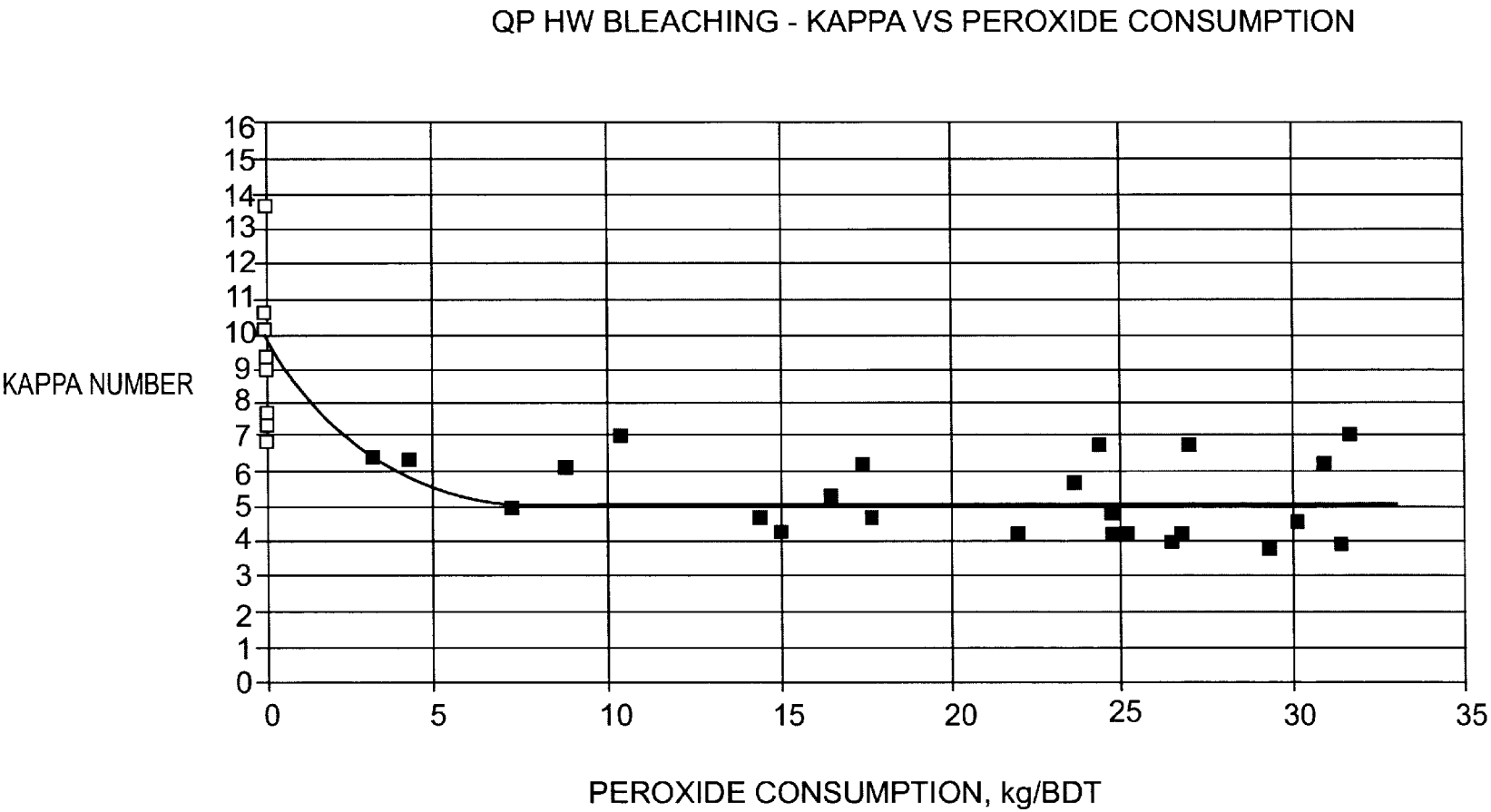
FIGS. 1–5 show the relationship between kappa number and kappa reduction with peroxide consumption.

In connection with the description below, reference is made to:

FIG. 1, which shows the relationship between the kappa number and the peroxide consumption for hard wood pulp, from which it can be seen that no real kappa reduction is achieved with a peroxide consumption exceeding 7 kilo/BDTM.

Figure 2:
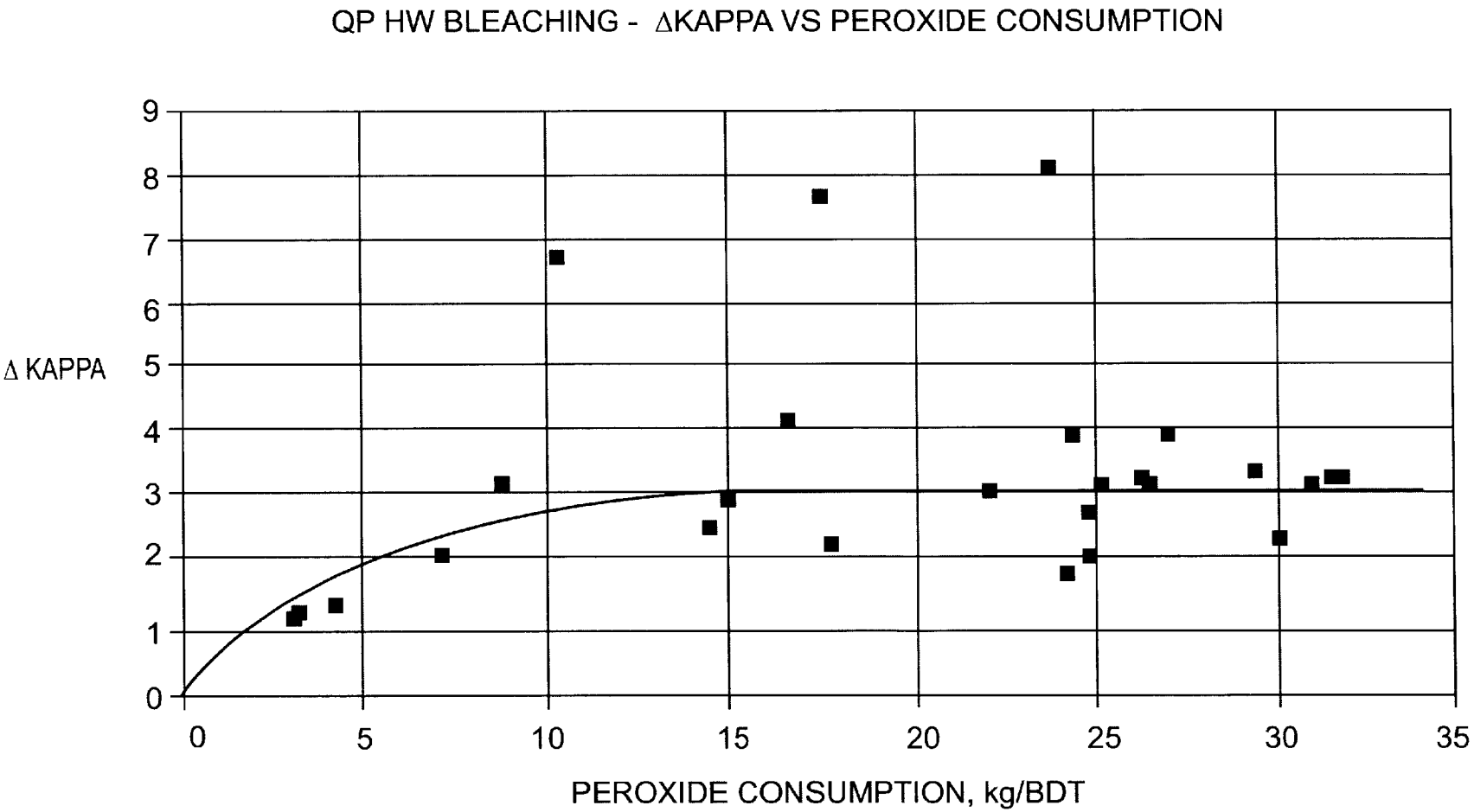

FIG. 2, which shows a diagram of the relationship between kappa reduction and the peroxide consumption for hard wood pulp, from which it can be seen that approximately a good 60% of the kappa reduction was brought about with a consumption of 5 kilo/BDTM, that more than 90% of the kappa reduction was obtained with a consumption of 10 kilo/BDTM, and that no further real kappa reduction is produced by peroxide consumptions exceeding 15 kilo/BDTM.

Figure 3:
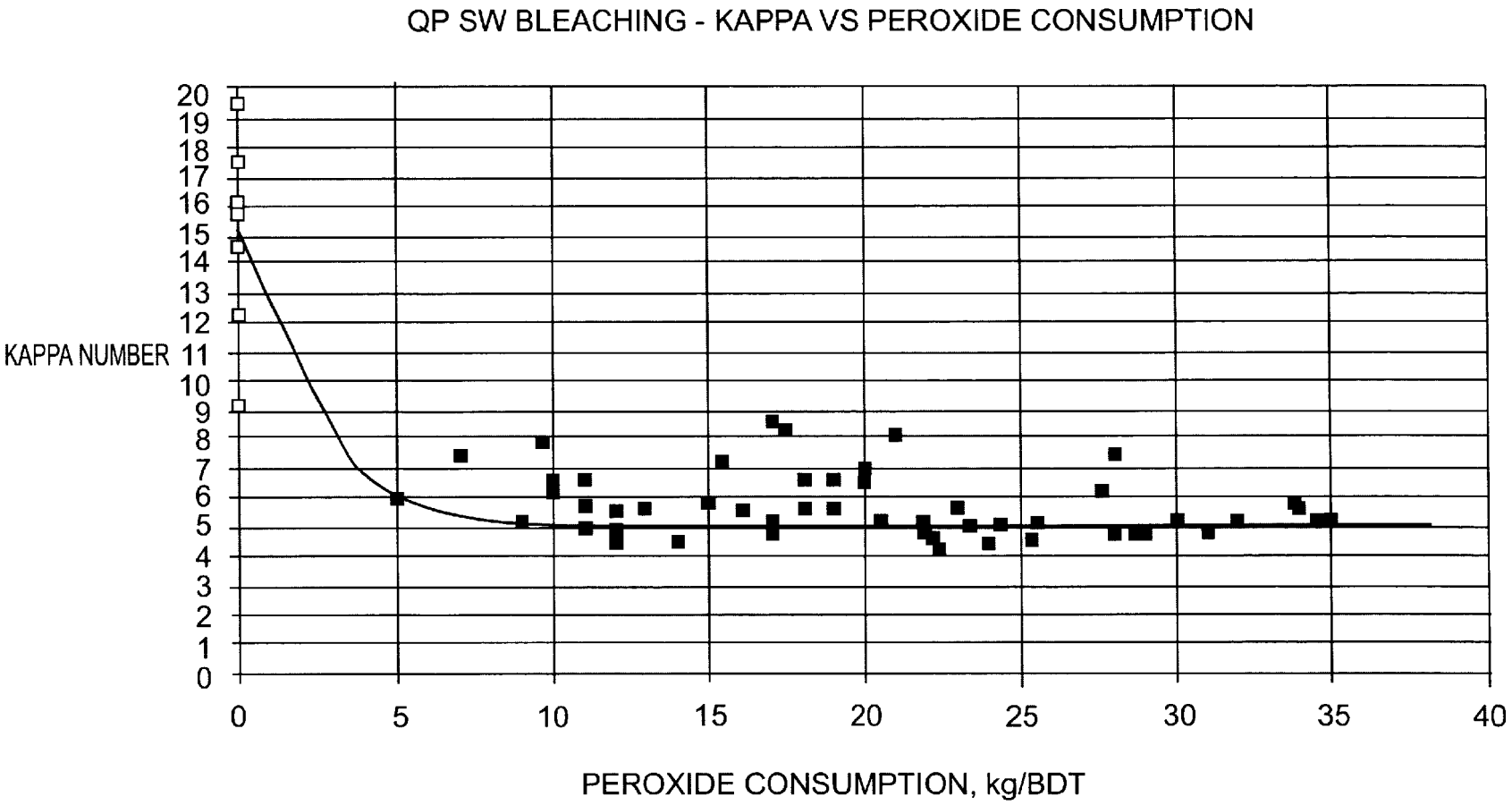

FIG. 3, which shows a diagram of the relationship between the kappa number and the peroxide consumption for soft wood, from which it can be seen that no further real decrease in the kappa number is produced by peroxide consumptions exceeding 10 kilo.

Figure 4:
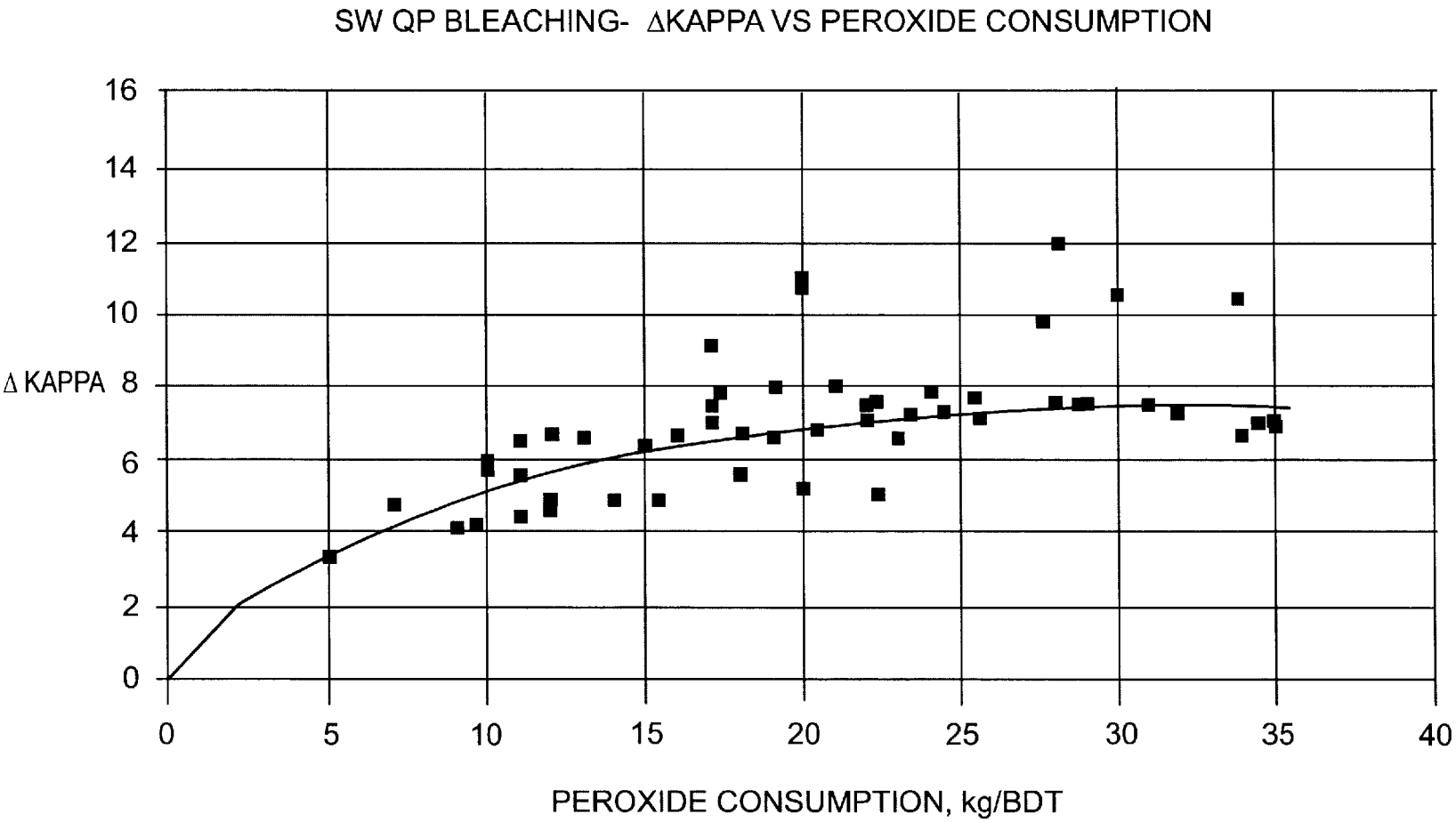

FIG. 4, which shows a diagram of the relationship between kappa reduction and peroxide consumption for soft wood pulp, from which it can be seen that about 50% of the reduction was achieved with a consumption of about 5 kilo/BDTM, that about 70%. of the kappa reduction was achieved with a consumption of about 10 kilo, and that about 85% of the kappa reduction was achieved with a consumption of about 15 kilo.

Figure 5:
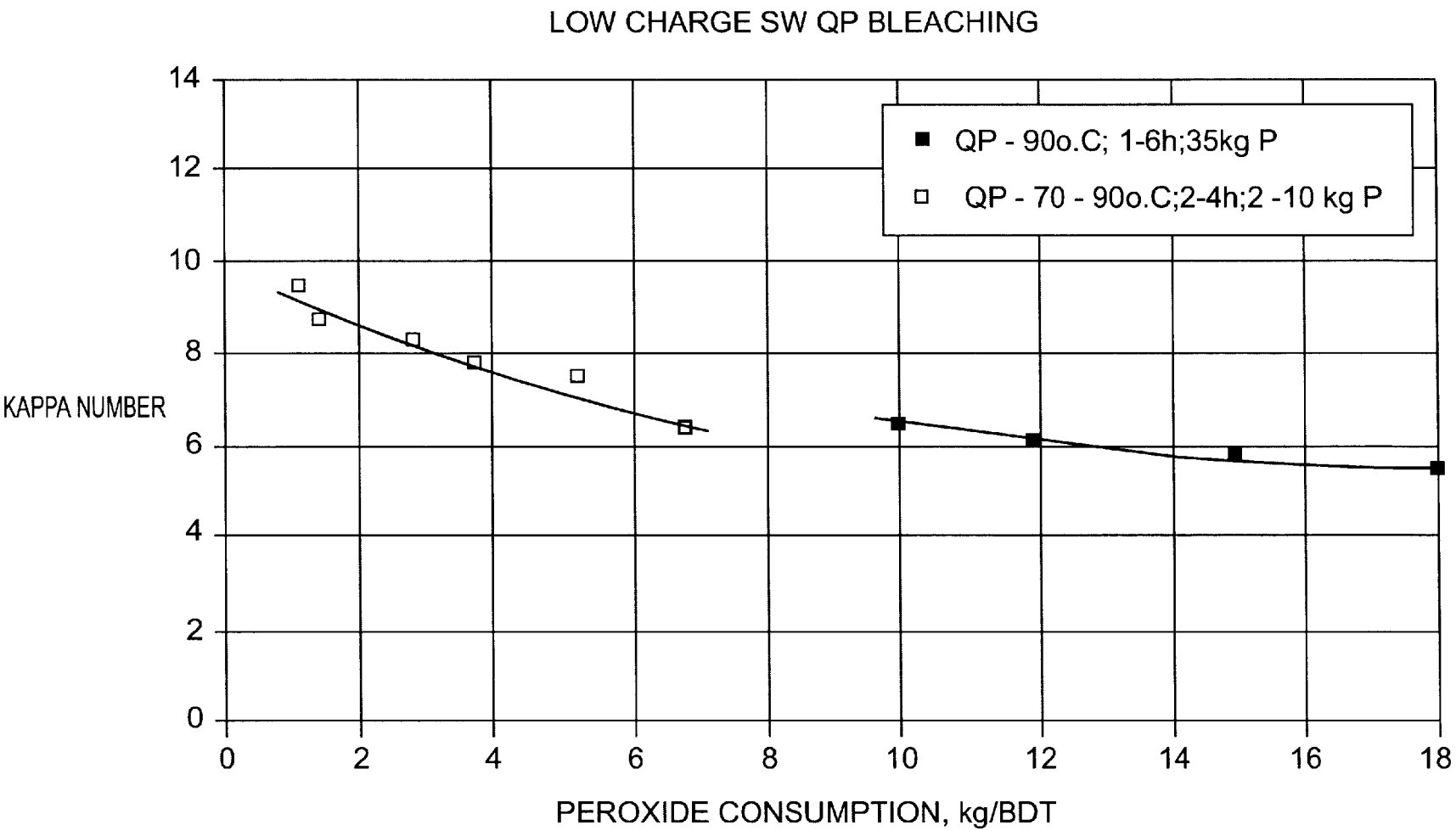

FIG. 5, which shows the relationship between kappa number and peroxide consumption for soft wood pulp, on the one hand in association with low peroxide charge in accordance with the invention, and, on the other, in association with conventional high peroxide charging, from which it can be seen that above a certain level of peroxide consumption no real kappa reduction is produced.

Figure 6:
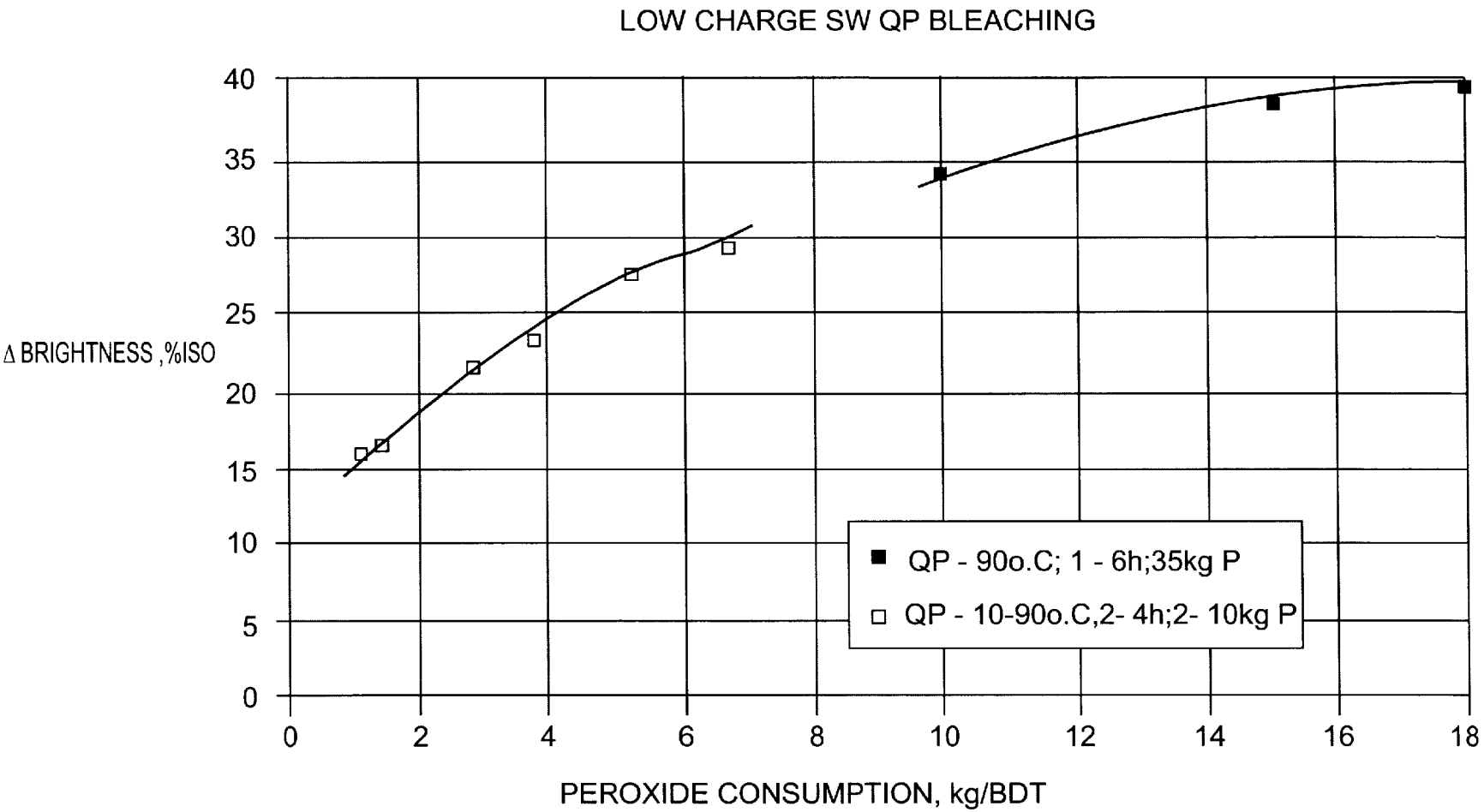
FIGS. 6–8 show the relationship between brightness and viscosity with peroxide consumption.

FIG. 6, which shows a diagram of the relationship between brightness and peroxide consumption, on the one hand in association with low peroxide charging in accordance with the invention and, on the other, in association with conventional high peroxide charging, from which it can be seen that the increased charging has a brightness-increasing effect. It is thus evident that the high charges of peroxide only give rise to an increase in brightness and not to any further delignification.

Figure 7:
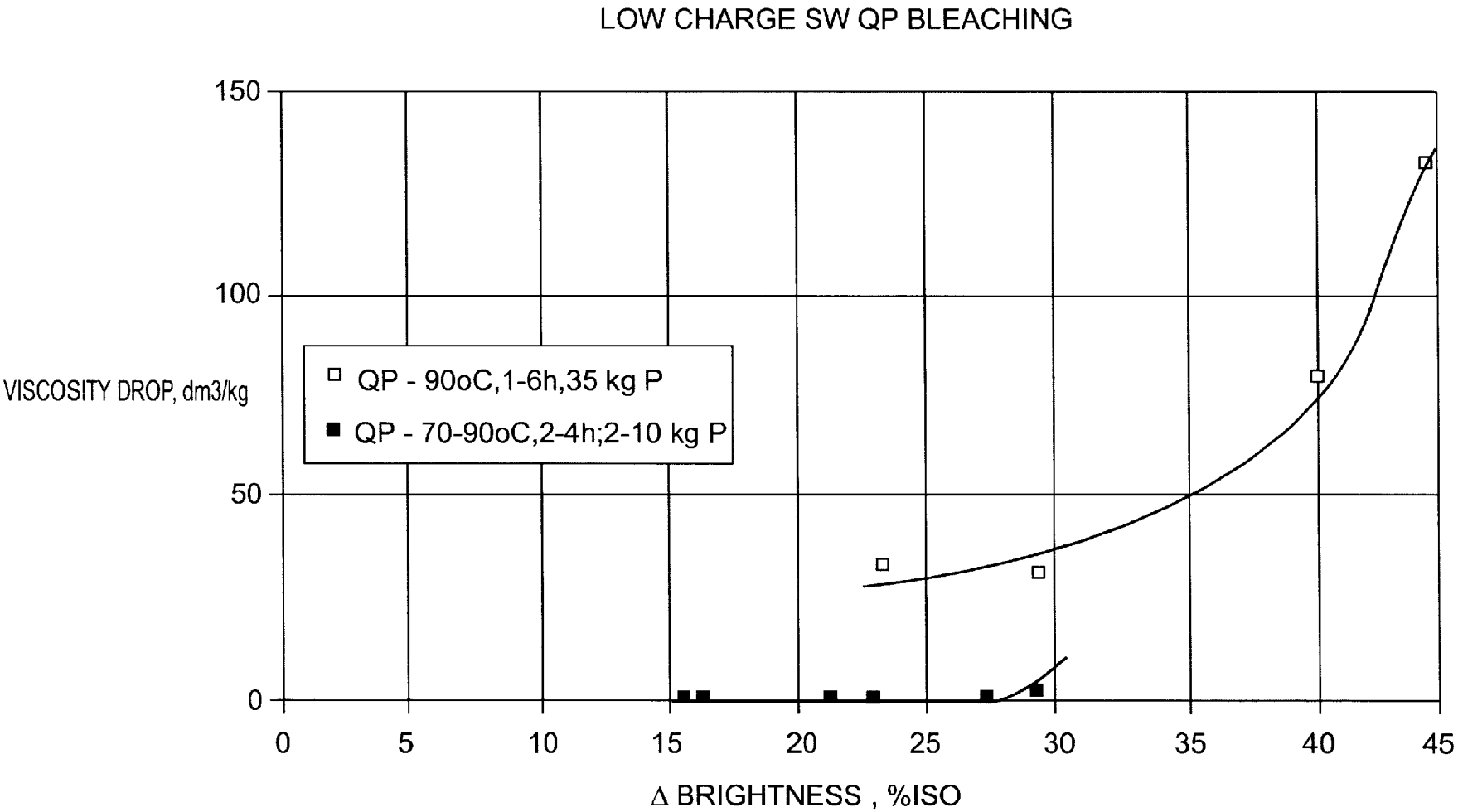

FIG. 7, which shows a diagram of the relationship between viscosity decrease and brightness for soft wood pulp, on the one hand in association with peroxide charging according to the invention and, on the other, in association with conventional high peroxide charging, from which it can be seen that, in contrast to the conventional technique, charging according to the invention has no real effect in lowering viscosity.

Figure 8:
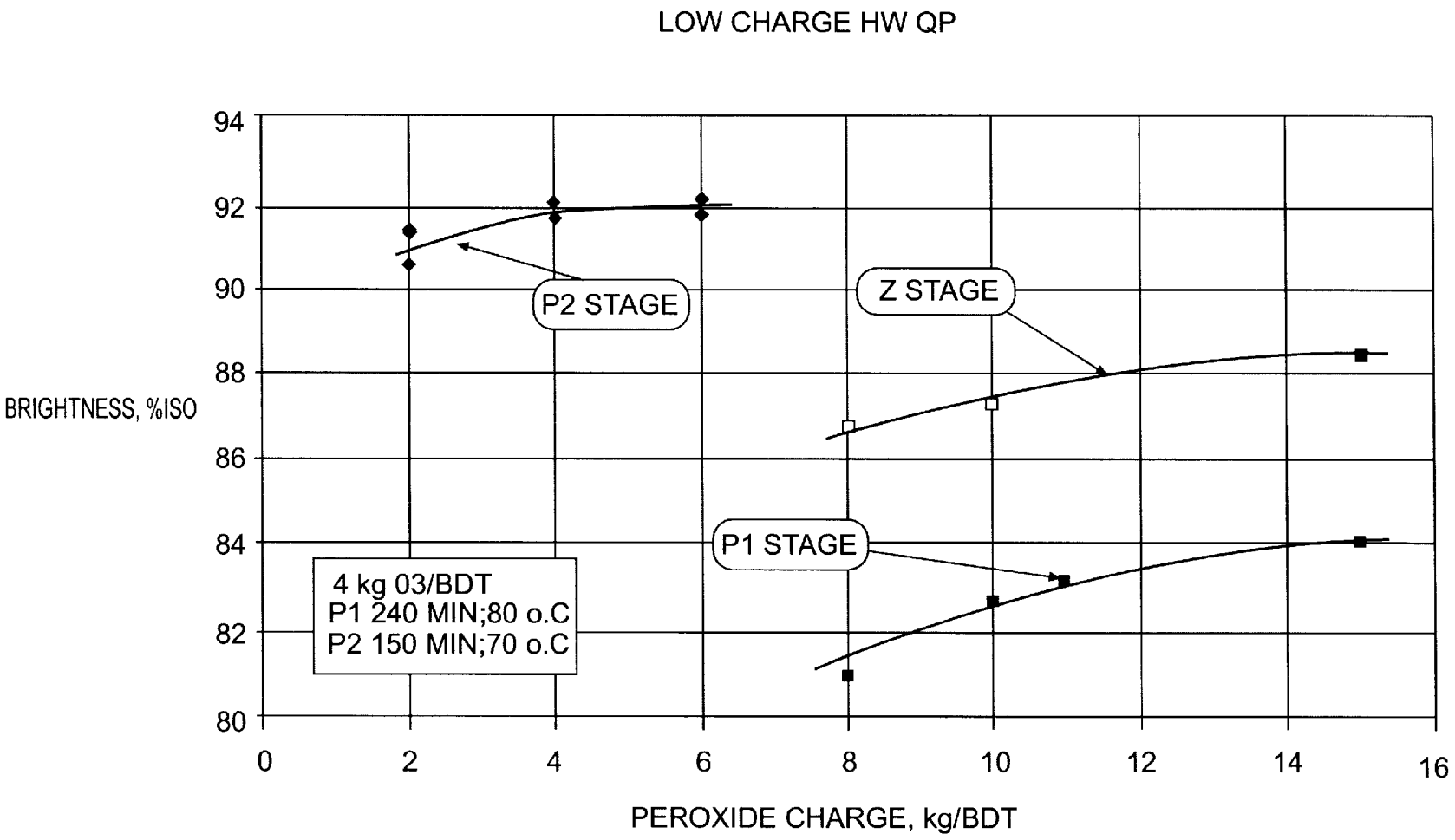

FIG. 8, which shows a diagram of the relationship between brightness and peroxide charging for hard wood pulp, in association with a three-stage sequence in accordance with the invention, from which it can be seen that a pulp having a very good brightness can be produced using a very low charge of peroxide, and thus at low bleaching cost.

Figure 9:
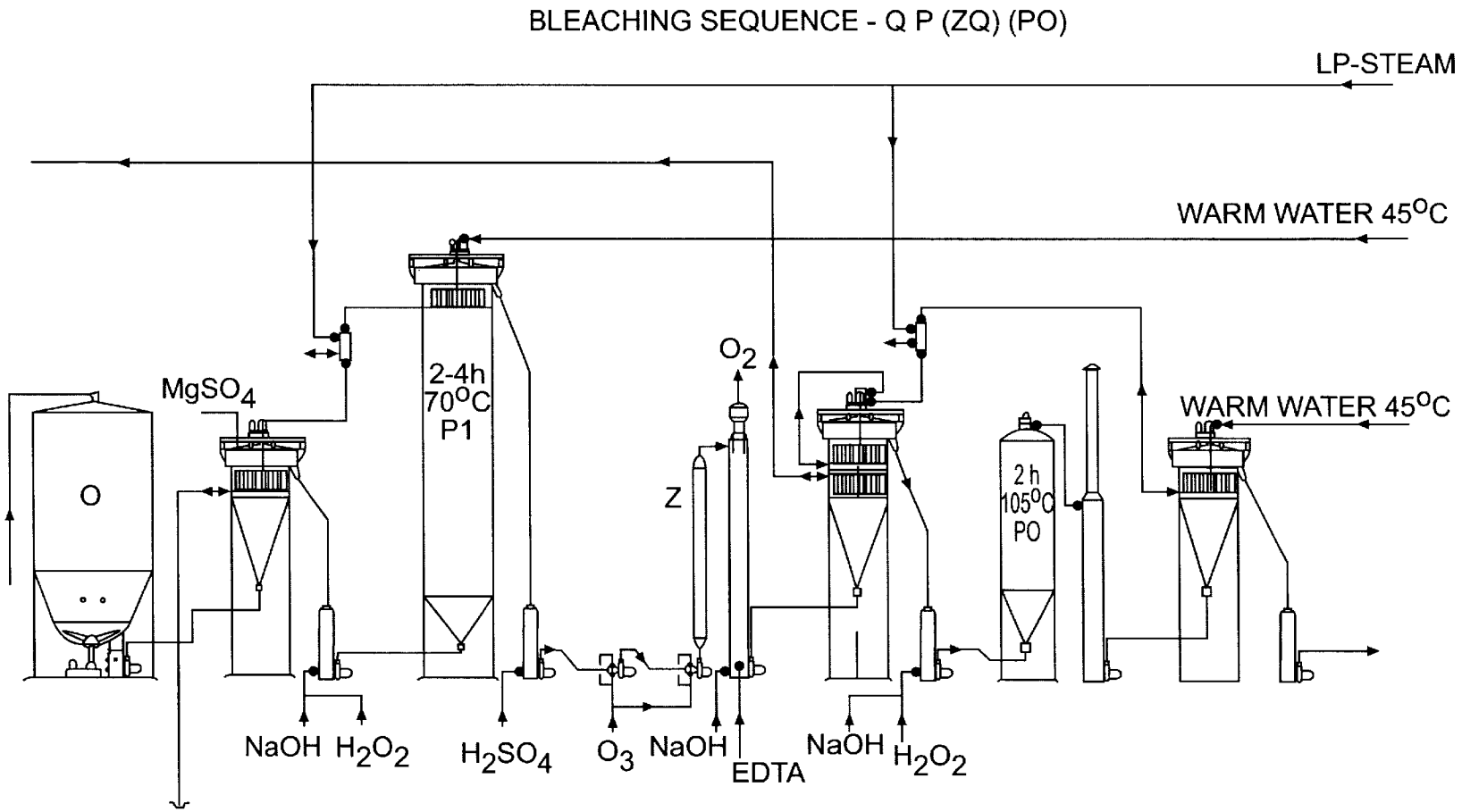
FIGS. 9 and 10 show apparatus for TCF bleaching plants.
Figure 10:
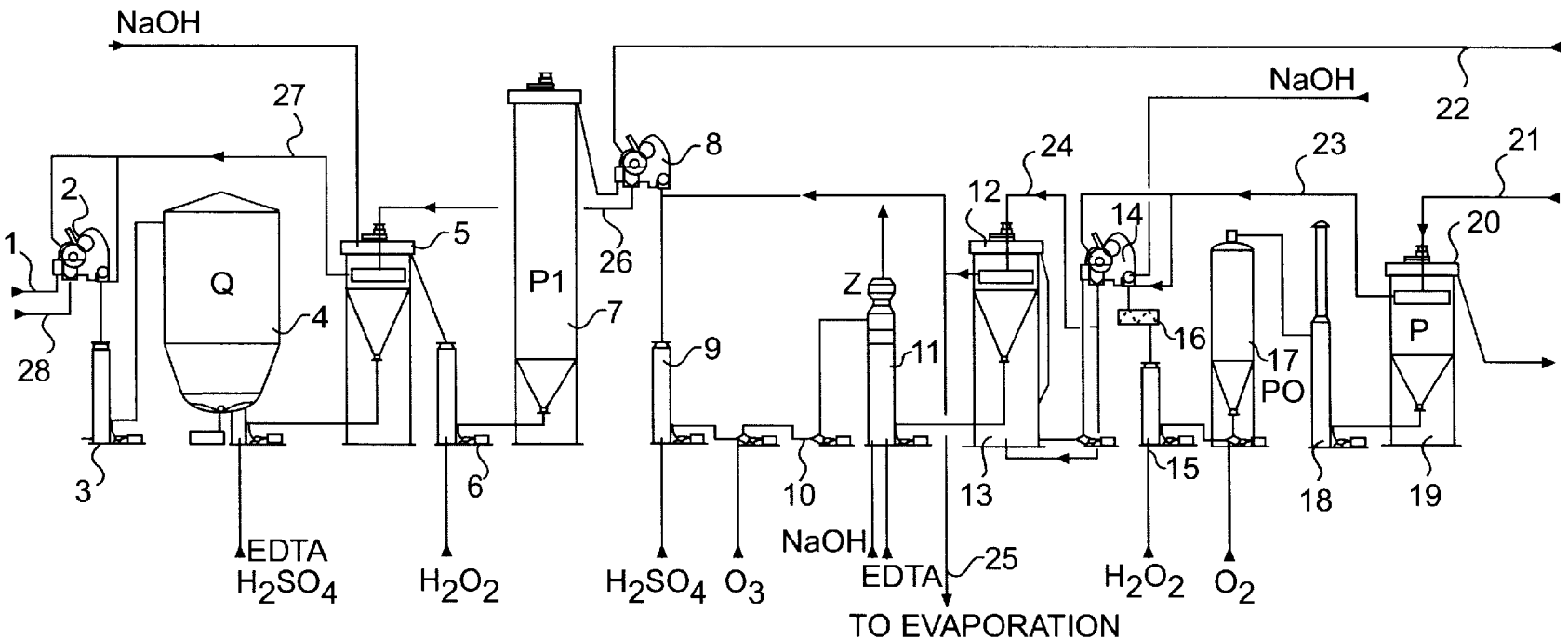

FIG. 9, which shows an exemplifying embodiment with regard to an apparatus array in a TCF bleaching plant according to the invention, and FIG. 10, which shows a preferred embodiment with regard to an apparatus array for a TCF bleaching plant.

The examples below illustrate the invention and illustrate the surprising result.

EXAMPLE 1

As per Table 1, a birch sulphate pulp, oxygen-bleached to kappa 9.5, was, on the one hand, treated in accordance with a previously known process A and, on the other, in accordance with the invention B. It is clearly evident from the Table that a pulp can be produced in accordance with the invention which costs less in chemicals and which has a higher quality (viscosity).

EXAMPLE 2

FIG. 9 shows a flow scheme concerning an embodiment which exemplifies the invention. The proposed bleaching sequence is QP (ZQ) (PO). The liquid balance is an example which shows one of many possible solutions. Consumption data and performance are presented in Table 2. These show that, as in Example 1, it is possible, in accordance with the invention, to produce a pulp having very good properties for a very low consumption of chemicals.

FIG. 10 shows a preferred embodiment concerning an apparatus array in a TCF bleaching plant, preferably with a view to carrying out the process for which a patent is being applied in this patent application. However, it will be evident to the person skilled in the art that this apparatus array can also be used in association with other bleaching sequences.

Thus, FIG. 10 shows, with the aid of a thicker flow line 1, how the pulp entering from the left in the figure is sequentially moved through the bleaching plant between the different pieces of apparatus. The first apparatus in the bleaching line is a storage tower 4. After the storage tower 4, there follows a Kamyr simple diffuser 5 with a chute 6.

After that, there comes a first P bleaching tower 7, after which the pulp is conducted to a first washing press 8 to be included in the bleaching, with chute 9 connected to it. From the chute, the pulp is pumped to at least one ozone-mixer device 10, which is followed by a gas-separating device 11. After the gas separation, the pulp is conducted to a diffuser 12, which is arranged at the top of a storage tower 13. From the bottom of the storage tower 13, the pulp is conveyed to a second washing press 14 with a subsequent chute 15 and preferably, arranged between them, a heating device 16 (expediently for low-pressure steam 1). From the latter chute 15, the pulp is pumped into the bottom of a bleaching vessel intended for pressurizing, preferably designed for a pressure at the top of at least 3 bar, more preferably 5 bar, and most preferably 10 bar. From the top of the pressure vessel 17, the pulp is conveyed onwards to a pressure release vessel 18, and after that onto a final bleaching tower 19, the top of which is arranged with a Kamyr diffuser 20.

The factors given below can be included in the advantages of an apparatus array in accordance with the above. A general advantage of using diffusers as washers is that they have very low energy consumption. In addition, the diffusers do not require a separate building, since the diffusers are supplied with in-built service platforms which provide a good working environment. In those cases where it is desired, it is also an advantage that very high degree of washing efficacy can be obtained with a diffuser. In connection with TCF bleaching, and the desirability of being able to construct a factory in which substantially no fluids (except the products) leave the factory, but rather the fluids circulate within it, it is important that the principle of countercurrent washing can readily be applied with the aid of a diffuser. In addition to this, it is also the case that the diffuser functions extremely well at high temperatures and takes up a minimal amount of space.

The location of washing presses in the positions shown above is due chiefly to the fact that at these positions there is (can be) a need for affecting the pulp consistency, i.e. chiefly for diluting after washing. A further reason for the given positions being selected for washing presses is the ability of the washing press to constitute an efficient liquid seal in relation to a subsequent stage, as a result of which good flexibility is obtained with regard to differences in pH and temperature. As a general point, it can be stated that a very good washing sequence is obtained by using a diffuser followed by a washing press. In accordance with a preferred embodiment, all the pieces of apparatus are manufactured in stainless steel (for example SIS 2364) Cost advantages, inter alia, are gained by using bleaching chemicals (TCF) which do not require special materials (for example titanium) for corrosion reasons.

In connection with using the preferred apparatus array in accordance with the invention, the total water consumption is calculated to be less than 20 $m^3$/ADMT, preferably to be about 15 $m^3$/ADMT, with about 10 $m^3$/ADMT being supplied to the final diffuser 20 in the form of washing liquid and about 4.5 $m^3$/ADMT being supplied to the first washing press 8 in the form of washing liquid. The departing filtrate 23 from the final diffuser 20 is conveyed in countercurrent to the second washing press 14 and as dilution liquid after the said washing press 14. Alternatively, a part, or the whole, of the filtrate 23 which is used as washing liquid for washing press 14 can be replaced by water or evaporation condensate, and excess liquid 23 can be sent to evaporation. Departing filtrate 24 from the washing press 14 is mainly conveyed, in countercurrent as washing liquid, to the central diffuser 12. One constituent stream of filtrate 25, departing from the central diffuser 12, is conveyed (preferably about 5 $m^3$/ADMT) preferably to evaporation, and a second constituent stream is used as dilution liquid after the first washing press 8. Filtrate 26 departing from the first washing press 8 is conducted in countercurrent, as washing liquid, to the first diffuser 5. Departing filtrate 27 from this first diffuser 5 is preferably used as washing liquid, and, where necessary, as dilution liquid, for the first washing press 2, with this filtrate, too, thus being intended for being conveyed in countercurrent. Alternatively, this filtrate 27 is also allowed to go to effluent/evaporation.

The preferred processes, in connection with which the said individual pieces of apparatus in this preferred apparatus array are used, will be described below. The washing press 2, which is not included in the bleaching line, is used chiefly for washing out organic material, the filtrate 28 preferably being conveyed in countercurrent to the preceding washing apparatus which is usually included in an oxygen delignification plant. In addition, the washing press is used for regulating the optimum pulp consistency for the subsequent chute 3, which constitutes the buffer for the pump for the storage tower 4. In connection with pumping out from the storage tower 4, chelating agent (preferably EDTA) is added and a pH adjustment (preferably pH 4–6) is made. The Q treatment is provided with the possibility of acting in the cone leading up to the diffuser, as a result of which metals are bound in complex form. The metal-containing complexes are washed out down to the desired level in the diffuser 5. Experiments carried out under the auspices of Kamyr AB have shown that it is advantageous for this washing not to be carried out with too high a degree of washing efficacy, in which washing efficacy is defined as $(x-y)/\times 100$; where x is the quantity of measured substance in the pulp which enters into the system for washing and y is the remaining quantity of the same after washing. This washing efficacy should preferably be less than 90%, preferably be less than 85% and more preferably be between 70 and 80%. Despite using an apparatus (diffuser) having a high degree of washing efficacy, Kamyr AB has succeeded, in the preferred example, in achieving a sufficiently low total washing efficiency by conveying the filtrate from the diffuser in countercurrent. After the diffuser wash 5, the pH is adjusted upwards, preferably by adding sodium hydroxide. It has been found that the Q stage prior to the first P stage can be dispensed with in the case of certain pulps which have a low content of metal ions.

In connection with pumping out, a relatively small quantity of peroxide is added to the chute 6 after the diffuser, which peroxide is intended chiefly to have a delignifying effect on the pulp in the first P bleaching tower 7. After the first P stage, there follows a washing press 8. In the chute 9, prior to the ozone stage, there is a washed pulp having the desired consistency. By adding an appropriate acid, the pH is lowered to a level (preferably pH 2–5) which is suitable in connection with ozone bleaching. After that, the pulp is pumped to a mixer device 10, to which the ozone gas is added. Preferably, two or more mixers are used which are arranged in series one after the other in order to achieve thorough admixture of the ozone. Subsequently, the ozone bleached/delignified pulp is conveyed onwards to a degasification vessel 11.

According to a more preferred embodiment, the ozone bleaching takes place at relatively high pressure, i.e. at a pressure exceeding 5 bar, preferably around 8–10 bar (or higher), and without using any actual reactor vessel following the mixers.

The reason for this is that the ozone reacts/decomposes so rapidly that there is very little need for the reactor vessel. A simple pipe conduit can be sufficient. It has also been found that, in existing ozone plants, violent vibrations arise in connection with releasing the pressure on the pressurized pulp. According to a preferred embodiment of the invention (which is not limited to its use in connection with the remaining pieces of apparatus shown here) a static mixer device is placed in connection with the inlet to the pressure-release vessel 11 (the inlet is preferably located at the bottom), which static mixer device utilizes the pressure by a final admixture, and thereby also lowers (by the drop in pressure) the pressure which exists at the outlet leading to the pressure-release vessel 11, whereby problems with vibrations can be eliminated. Any form of static mixer device whatever can be conceived as being used, but an adjustable device of Kamyr's is dp mixer type (see Patent Application SE9100838) is expediently used.

After the ozone stage, there follows, without any intermediate wash, a new Q stage, which must be arranged in association with a very good degree of washing efficacy. Thus, a washing efficacy of at least 85%, preferably at least 90% and most preferably at least 95%, should be achieved in the wash 12 which is arranged to follow this Q stage. This wash consists preferably of a washing diffuser 12 followed by a washing press 14. In the structure for supporting the washing press 14 there is expediently arranged a device 16 for admixture of low-pressure steam in order to raise the temperature prior to the pressurized peroxide stage 17, see SE9301960 Kamyr AB. In the said stage 17, a considerable part of the bleaching of the fibres in the pulp is carried out by adding NaOH and a dose of peroxide which is relatively high, in this second stage, in relation to $P_1$. A certain quantity of oxygen gas can also be added to a mixer which is arranged at the bottom of the pressurized peroxide bleaching vessel 17. By also maintaining the pH below 11.5 (relatively low) in this bleaching vessel 17, the treatment of the pulp is even milder and a finished bleached pulp with better properties than normal can thus be obtained. The bleached pulp is fed out from the top of the bleaching vessel and is conveyed to a pressure-release device 18, after which the pulp is conveyed to a further bleaching tower 19 for bleaching with the aid of the remaining residual peroxide. The final washing of the pulp then takes place at the top of the said bleaching tower using a diffuser 20.

A great advantage of the example shown is that the combination of an ozone stage followed by a Q stage provides very good metal separation, which is of great value prior to the pressurized peroxide stage. In addition to this, the equipment shown, and the flow arrangement, can return all residual peroxides. Above all, the process shown provides a finished bleached pulp, which is suitable for the market and has very good properties, for a uniquely low consumption of chemicals, while using TCF bleaching.

It will be evident to the person skilled in the art that the process described is not limited by the above mentioned examples but can be varied within the scope of the subsequent patent claims. Thus, it is evident that, instead of using ozone, peracids, for example, or an acid P stage can be used in the delignifying acid stage.

The abbreviated designations for different bleaching stages, which are prevalent within the "specialty" have been used virtually throughout, thus "P" refers to peroxide, "Z" refers to ozone and "Q" refers to chelating agents. The preferred peroxide is hydrogen peroxide and the preferred chelating agent is EDTA or DTPA, it being understood, however, that equivalent chemicals which are well known to the person skilled in the art can be used.

In addition, it is evident that the washing apparatus described can be replaced by similar types of apparatus having a similar function, it being understood that a diffuser mainly functions in accordance with the displacement washing principle and a washing press in accordance with the displacement and thickening principle.

Example 1, Table 1

| QP (ZQ) P bleaching of mill HW oxygen-delignified pulp | | |
|---|---|---|
| Kappa No. | 9.5 | |
| Viscosity, $dm^3$/kg | 1026 | |
| Q Stage | | |
| Consistency, % | 10 | |
| Temperature, ° C. | 70 | |
| Time, min | 60 | |
| Charge EDTA, kg/BDMT | 2 | |
| Final pH | 5.6 | |
| P1 stage | A | B |
| Consistency, % | 10 | 10 |
| Temperature,° C. | 85 | 85 |
| Time, min | 240 | 240 |
| Charge $H_2O_2$, kg/BDTM | 30 | 5 |
| Final pH | 10.4 | 10.5 |
| Brightness, % ISO | 81.6 | 72.8 |
| ZQ stage | | |
| Consistency, % | 10 | 10 |
| Temperature, ° C. | 50 | 50 |
| Charge $O_3$, kg/BDMT | 4 | 4 |
| Initial pH | 3 | 3 |
| Time, min | 60 | 60 |
| Charge $H_2O_2$, kg/BDMT | 2 | 2 |
| Final pH | 7.4 | 7.1 |
| Brightness, % ISO | 85.7 | 80.8 |
| P2 stage | | |
| Consistency, % | 10 | 10 |
| Temperature, ° C. | 75 | 75 |
| Time, min | 240 | 240 |
| Charge $H_2O_2$, kg/BDMT | 5 | 15 |
| Final pH | 11.2 | 11.3 |
| Kappa No. | 0.9 | 0.8 |
| Viscosity $dm_3$/kg | 746 | 812 |
| Brightness, % ISO | 90.8 | 90.4 |

Example 2, Table 2
QP (ZE) PO bleaching of oxygen-delignified HW kraft pulp

| | |
|---|---|
| Initial properties | |
| Kappa No. | 7.5 |
| Viscosity, $dm^3/kg$ | 1133 |
| O stage | |
| Consistency, % | 10 |
| Temperature, ° C. | 70 |
| Time, min | 52 |
| Charge EDTA, kg/BDMT | 2 |
| pH final | 6.0 |
| P1 stage | |
| Consistency, % | 10 |
| Temperature, ° C. | 70 |
| Time, min | 180 |
| Charge P, kg/BDMT | 2 |
| pH final | 10.8 |
| Brightness, % ISO | 70.0 |
| ZE stage | |
| Consistency, % | 10 |
| Temperature, ° C. | 50 |
| Charge $O_3$, kg/BDMT | 4.0 |
| pH initial | 3.0 |
| Charge NaOH, kg/BDMT | 6.0 |
| pH final | 6.8 |
| Brightness, % ISO | 80.8 |
| (PO) stage | |
| Pressurized: | |
| Consistency, % | 10 |
| Temperature, ° C. | 105 |
| Time, min | 60 |
| Charge P, kg/BDMT | 6 |
| pH final | 9.9 |
| Brightness, % ISO | 90.3 |
| Atmospheric: | |
| Temperature, ° C. | 95 |
| Time, min | 90 |
| pH final | 10.0 |
| Kappa No. | 0.6 |
| Viscosity, $dm^3/kg$ | 729 |
| Brightness, % ISO | 91.0 |

What is claimed is:

1. A method of bleaching chemical paper pulp or dissolving wood pulp, which has been cooked and delignified without employing chlorine-containing chemicals, comprising a bleaching sequence for bleaching chemical pulp which comprises at least 4 stages, a first stage comprising a chelation treatment stage;

a second stage comprising a first peroxide treatment stage, wherein said first peroxide treatment stage is a delignifying peroxide treatment stage, in which the amount of peroxide is between 2 and 8 kilo/bone dry metric tons, a third stage comprising an acidic delignifying treatment stage, following said second stage and including a wash, and a fourth stage comprising a second peroxide treatment stage, following said third stage and including a wash, wherein said second peroxide treatment stage is a bleaching peroxide treatment, in which the amount of peroxide exceeds 3 kilo/bone dry metric tons and exceeds the amount of peroxide employed in said first peroxide stage.

2. The method according to claim 1, wherein said acidic delignifying treatment stage is an ozone treatment stage.

3. The method according to claim 2, wherein said ozone treatment stage is followed by a chelation stage without any intermediate wash, and wherein the chelation stage is followed by the fourth stage.

4. The method according to claim 1, wherein said acidic delignifying treatment stage comprises treatment with at least one member selected from the group consisting of an organic peracid, an acid, and peroxide, followed by a chelation treatment stage without any intermediate wash, wherein the chelation treatment stage is followed by the fourth stage.

5. The method according to claim 1, wherein the amount of peroxide in said second stage is between 3 and 7 kilo/bone dry metric tons.

6. The method according to claim 1, wherein the amount of peroxide in said second stage is between 4 and 6 kilo/bone dry metric tons.

7. The method according to claim 1, wherein the amount of peroxide in said second peroxide treatment stage exceeds 6 kilo/bone dry metric tons and is less than 20 kilo/bone dry metric tons.

8. The method according to claim 1, wherein the amount of peroxide in said second peroxide treatment stage exceeds 8 kilo/bone dry metric tons and is less than 20 kilo/bone dry metric tons.

9. The method according to claim 1, wherein the amount of peroxide in said second peroxide treatment stage is between 9 and 15 kilo/bone dry metric tons.

10. The method according to claim 1, wherein filtrate from said fourth treatment stage is supplied to said second stage, such that residual peroxide can be utilized in said second stage.

11. The method according to claim 1, wherein said acidic delignifying treatment stage includes a chelation treatment stage, wherein the chelation treatment stage is followed by the fourth stage.

12. The method according to claim 11, wherein said chelation treatment stage employs EDTA.

13. The method according to claim 1, wherein said second peroxide treatment stage is carried out at elevated temperature and pressure and wherein the pH is less than 11.5.

14. The method according to claim 13, wherein said second peroxide treatment stage is carried out at a temperature above 100° C. and at a pressure exceeding 2 bar and wherein the pH is 10–11.

15. The method according to claim 1, wherein the delignifying peroxide treatment stage is carried out at pH<7.

16. The method according to claim 15, wherein the delignifying peroxide treatment stage is carried out at pH<5.

* * * * *